United States Patent [19]

Hukase

[11] Patent Number: 4,669,553

[45] Date of Patent: Jun. 2, 1987

[54] PERCUSSION TOOL

[76] Inventor: Yutaka Hukase, No. 8-48, Maruyama 2-chome, Kamagaya-shi, Chiba-ken, Japan

[21] Appl. No.: 693,972

[22] PCT Filed: May 11, 1984

[86] PCT No.: PCT/JP84/00239

§ 371 Date: Jan. 11, 1985

§ 102(e) Date: Jan. 11, 1985

[87] PCT Pub. No.: WO84/04482

PCT Pub. Date: Nov. 22, 1984 (Under 37 CFR 1.47)

[30] Foreign Application Priority Data

May 13, 1983 [JP] Japan ..... 58-082496

[51] Int. Cl.[4] ..... F01L 21/04; B25D 9/04; B25D 9/16

[52] U.S. Cl. ..... 173/127; 173/133; 173/134; 91/229

[58] Field of Search ..... 173/114, 126, 127, 132, 173/134–137; 91/229

[56] References Cited

U.S. PATENT DOCUMENTS

| | | | |
|---|---|---|---|
| 678,759 | 7/1901 | Payton | 173/136 X |
| 682,492 | 9/1901 | Payton | 173/136 X |
| 884,971 | 4/1908 | Albree | 173/136 X |
| 1,117,884 | 11/1914 | Montgomery | 173/127 |

*Primary Examiner*—E. R. Kazenske
*Assistant Examiner*—John L. Knoble
*Attorney, Agent, or Firm*—Jordan and Hamburg

[57] ABSTRACT

A percussion tool utilizing a reciprocatory piston movement for applying an impact force on to a working surface including a casing (1) having disposed axially therein a hammer member (12), an anvil (5) impacted by the hammer member and a chisel point (4) supported by the anvil. A spool valve (18) is located within the interior of the hammer member for reciprocatory movement in unison with the hammer member, the control the flow of a pressurized working fluid supplied to the hammer member, to thereby cyclically move the hammer member in reciprocatory movement.

5 Claims, 3 Drawing Figures

PERCUSSION TOOL

DESCRIPTION

1. Technical Field

This invention relates to a percussion tool suitable for use in breaking into pieces a working surface by a chisel point by utilizing the impacting force exerted by a hammer member on an anvil.

2. Background Art

Percussion tools have been widely utilized in the construction and manufacturing fields for such diverse applications as paving breaking, pile driving, impact hammering and casting deburring. In these applications, a percussion tool has particular utility in crushing into pieces the asphalt pavement of a road when the road is to be repaired or the wall of a building when the building is to be repaired. In these applications, a pointed forward end of a chisel or chisel point is abutted against the working surface, such as the surface of the pavement or the wall, and the hammer member mounted within a tool casing is moved in axial reciprocatory movement to impact the anvil supporting the chisel point to force the chisel point into a layer below the working surface by penetrating and braking it into pieces. In the crushing operation described hereinabove the hammer member is moved in axial reciprocatory impacting movement to exert an impact force on the anvil supporting the chisel point, and it has been usual practice to provide a special drive unit for reciprocatorily moving the hammer member within the tool casing. Thus, the percussion tools of the prior art have suffered the disadvantage that the tool itself becomes large in size due to the provision of the drive unit for driving the hammer member for reciprocatory movement.

When the aforesaid boring operation is performed, the operator has to grip a handle of the tool and hold same by hand during operation. Although the prior art percussion tools have proven generally effective to accomplish their desired function, they have possessed inherent deficiencies. Foremost of these deficiencies has been the extremely high vibration force communicated to the operator of the tool during reciprocatory movement of the hammer member within the tool casing. Such vibration has necessarily caused discomfort to the operator, making it impossible for the operator to continue the operation over a prolonged period of time by enduring the discomfort and overcoming fatique that inevitably preyed on him.

The percussion tools of the construction and operation described hereinabove are not necessarily held by the operator in performing their function. When necessary, they may be attached to a suitable working machine, such as a back-how, to perform their function. With the extremely high vibratory force generated by the hammer member which is reciprocatorily moving in the tool casing, it would become necessary to use a working machine of a larger size than the one which would normally be used.

This invention has been developed for the purpose of obviating the aforesaid disadvantages of the prior art. Accordingly, the invention has as its object the provision of a percussion tool enabling an overall compact size to the obtained in a percussion tool and capable of minimizing the vabration force generated when the hammer member moves in reciprocatory impacting moving within the tool casing.

DISCLOSURE OF THE INVENTION

The aforesaid object is accomplished according to the invention by providing the percussion tool of the aforesaid type with features including a chisel point supported by an anvil, a casing having mounted therein the chisel point supported by the anvil for axial reciprocatory movement and defining therein a bore closed at one end by an impact receiving end of the anvil opposite an end at which the chisel point is supported, a hammer member mounted within the bore for reciprocatory impacting movement into and out of contact with the impact receiving end of the anvil, a stationary partition member located on an inner peripheral surface of the casing and maintaned in intimate contact with the hammer member for partitioning the bore defined by the casing into two bore sections or a first bore section remote from the impact receiving end of the anvil and a second bore section near the impact receiving end of the anvil, a movable partition member located at an outer periphery of a portion of the hammer member located in the first bore section and maintained in intimate contact with the inner peripheral surface of the casing, said movable partition member cooperating with said stationary partition member to define therebetween a suction chamber for moving the hammer member in reciprocatory movement, means for supplying a pressurized working fluid to said suction chamber, an outlet port for maintaining said second bore section in communication with the atmosphere, and valve means located inside the hammer member operative to alternately supply the pressurized working fluid to the suction chamber and allow same to flow to the bore defined by the casing.

BEST MODE OF CARRYING OUT THE INVENTION

A preferred embodiment of the invention will now be described by referring to the accompanying drawings.

Figure 1:
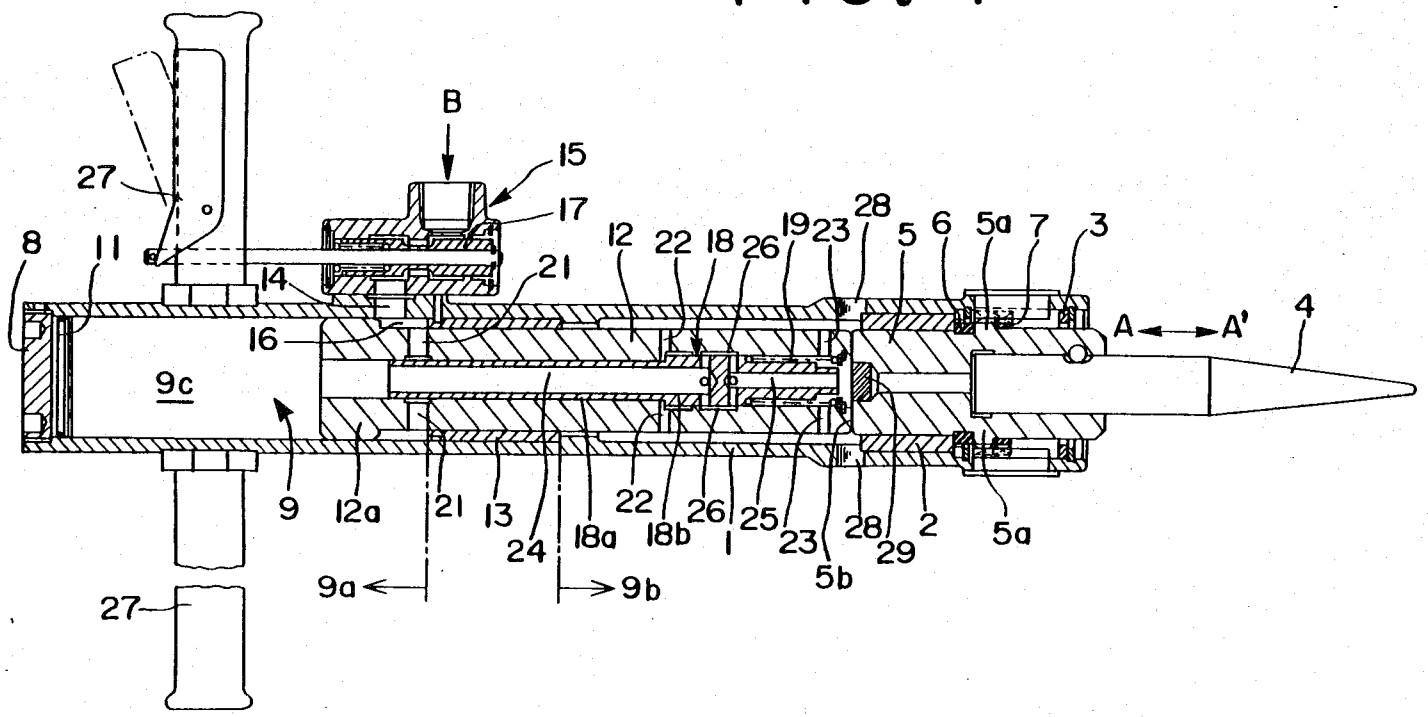
FIG. 1 is a sectional side view of the percussion tool in its entirety, comprising one embodiment of the invention.

Referring to FIG. 1 which is a sectional side view of the percussion tool in its entirety comprising the preferred embodiment, a casing 1 which is formed generally in an elongated cylindrical configuration has a first annular member 2 secured to its inner peripheral surface at a distal end portion thereof (a right end portion in the figure), the first annular member 2 being smaller in inner diameter than the casing 1. The casing 1 further has a second annular member 3 secured to its inner peripheral surface in a position further forwardly of the first annular member 2. The second annular member 3 supports for axial reciprocatory movement (in AA′ directions) an anvil 5 by which a chisel point 4 is supported. The anvil 5 includes an annular protuberance 5*a* extending radially outwardly from an outer periphery of the anvil 5 to be interposed between the first annular member 2 and second annular member 3. By virtue of this constructional form, the anvil 5 is capable of axial movement so long as the annular protuberance 5a can move between the first annular member 2 and second annular member 3. Shock absorbers 6 and 7 are attached to opposite ends of the annular protuberance 5a. An end cap 8 is rigidly mounted to an end (a left end in the figure) of the casing 1 opposite the end from which the chisel point 4 extends, and the casing 1 defines a bore 9 which is closed by the end cap 8 and the anvil 5 and extends leftwardly of an impact receiving end 5b of the anvil 5 to the end cap 8 at which the bore 9 is airtightly sealed by a seal member 11.

A hammer 12 having a length smaller in size than the entire length of the bore 9 is located in the bore 9 and supported substantially in a central portion of the bore 9 by a third annular member 13 secured to the inner peripheral surface of the casing 1 for reciprocatory movement axially of the casing 1 in AA' directions. The third annular member 13 which supports the hammer member 12 is described hereinabove serves concurrently as a stationary partition member for partitioning the bore 9 into a first bore section 9a located leftwardly of the member 13 and a second bore section 9b located rightwardly thereof. The first bore section 9a is maintained in communication with a suction valve 15 through an inlet port 14 formed in a wall of the casing 1.

The hammer member 12 includes a major diameter portion 12a located at a left end of the hammer member 12 and constituting a movable partition member maintained at its outer peripheral surface in intimate contact with the inner peripheral surface of the casing 1. Thus, a suction chamber 16 is defined between the major diameter portion 12a of the hammer member 12 constituting the movable partition member and the third annular member 13 serving as the stationary partition member for driving the hammer member 12 for reciprocatory axial movement. The inlet port 14 formed in the wall of the casing 1 communicates with the suction chamber 16.

A pressurized working fluid is supplied from a pressurized working fluid supply source, not shown, as indicated by an arrow B to the suction valve 15 including a valve body 17 which is manually operable to selectively lead the pressurized working fluid to the inlet port 14 formed in the wall of the casing 1 or stop the flow thereof to the inlet port 14. As the pressurized working fluid led to the inlet port 14 further flows into the suction chamber 16, the major diameter portion 12a of the hammer member 12 or the hammer member 12 in its entirety is moved leftwardly in FIG. 1 by the action of the pressurized working fluid, thereby increasing the volume of the suction chamber 16 defined between the major diameter portion 12a of the hammer member 12 and the third annular member 13.

A spool valve 18 including a minor diameter portion 18a and a major diameter portion 18b is fitted in a hollow section formed within the hammer member 12 including the major diameter portion 12a movable by the action of the pressurized working fluid and including a minor diameter portion and a major diameter portion. The spool valve 18 which is normally biased leftwardly in the figure by the biasing force of a compression spring 19 is located in a position in which a shoulder at the boundary between the minor diameter portion 18a and major diameter portion 18b abuts against a shoulder formed at the boundary between the minor diameter portion and major diameter portion of the hollow section of hammer member 12.

The hammer member 12 is formed with a first duct 21 for keeping the suction chamber 16 in communication with the hollow section within the hammer member 12, a second duct 22 for keeping the bore 9 in communication with the hollow section within the hammer member 12 at the shoulder and a third duct 23 located rightwardly of the second duct 22 for keeping the bore 9 in communication with the hollow section within the hammer member 12, to allow the pressurized working fluid to flow therethrough. When the spool valve 18 is in the position shown in FIG. 1, the first duct 21 is closed by the spool valve 18. The spool valve 18 is formed in its interior with two channels 24 and 25 substantially coaxial with each other which, in the condition shown in FIG. 1, is kept in communication with each other through a recess 26 formed at an inner peripheral surface of the hammer body 12.

A handle 27 rigidly affixed to the casing 1 near the end cap 8 and extending substantially perpendicular to the axis of the casing 1 is grasped by the operator when the percussion tool of the aforesaid construction is put to use.

In operation, as the handle 27 is grasped by the operator and the percussion tool is lifted, the annular protubrance 5a of the anvil 5 moves to a rightward position in which it abuts against the second annular member 3. Then, as the chisel point 4 is placed on a working surface, not shown, and forced thereagainst, the annular protuberance 5a moves to a leftward position in which it abuts against the first annular member 2 as shown in FIG. 1.

If the valve body 17 of the suction valve 15 is moved to an open position when the anvil 5 is in the aforesaid position, then the pressurized working fluid flows through the inlet port 14 into the suction chamber 16 and moves the hammer body 12 leftwardly. The spool valve 18 moves as a unit with the hammer member 12 in the illustrated condition. During the movement of the hammer member 12, the pressurized working fluid in a third bore section 9c leftwardly of the hammer member 12 flows through the channel 24 within the spool valve 18, the recess 26 at the inner peripheral surface of the hammer member 12, the channel 25 within the spool valve 18 and the third duct 23, to be discharged to outside through an outlet port 28 formed at the wall of the casing 1 at the distal end portion.

Figure 2:
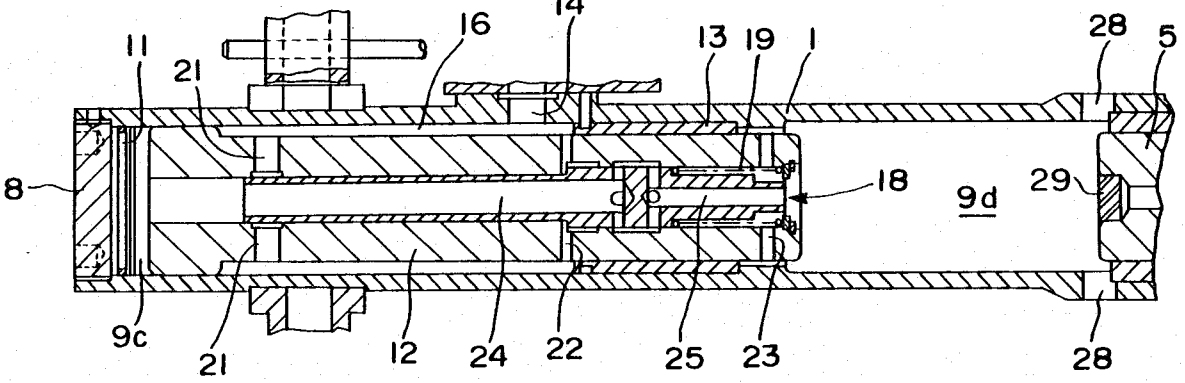
FIGS. 2 and 3 are fragmentary sectional side views of the percussion tool shown in FIG. 1, showing the manner of operation of the hammer member and the spool valve.

As the hammer member 12 moves leftwardly, the second duct 22 also moves gradually leftwardly in the figure. When the second duct 22 moves past the third annular member 13 to a position in which it is brought into communication with the suction chamber 16 as shown in FIG. 2, the pressurized working fluid within the suction chamber 16 flows through the second duct 22 on to the shoulder of the spool valve 18. The force of the pressurized working fluid exerted on the shoulder of the spool valve 18 moves the spool valve 18 rightwardly in the figure against the biasing force of the compression spring 19, to thereby bring the first duct 21 closed up to then by the spool valve 18 to an open position, as shown in FIG. 3.

Figure 3:
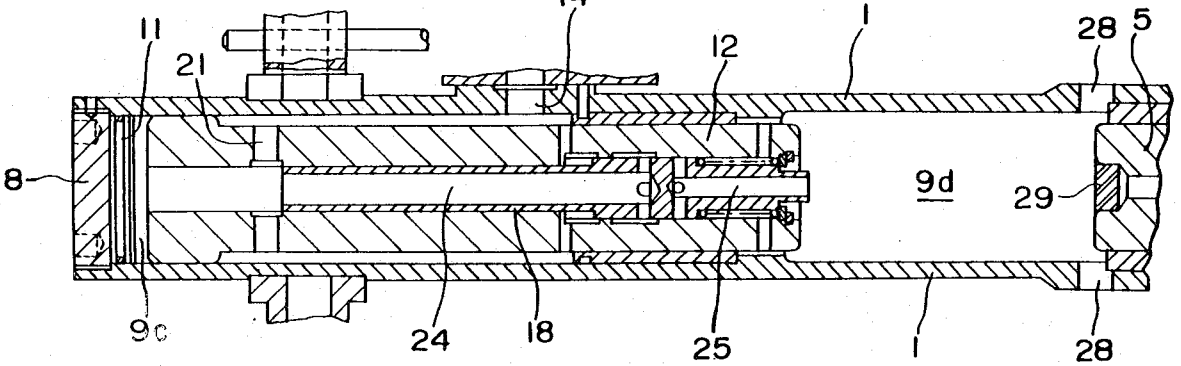

Referring to FIG. 3, the pressurized working fluid in the suction chamber 16 flows through the first duct 21, which is now open, into the third bore section 9c and the channel 24 within the spool valve 18. At this time, since the rightward movement of the spool valve 18 keeps the two channels 24 and 25 out of communication with each other as shown, all the pressurized working fluid within the suction chamber 16 flows into the third bore section 9c without being discharged from the casing 1 to outside. The force of the pressurized working fluid entering the third bore section 9c moves the hammer member 12 rightwardly, to impact the impact receiving end 5b of the anvil 5 as shown in FIG. 1. The impact given to the anvil 5 forces the chisel point 4 into the working surface to bore a hole therein. During the period the hammer member 12 cyclically impacts the anvil 5, the pressurized working fluid within a fourth bore section 9d which is disposed rightwardly of the hammer member 12 flows to the atmosphere through the outlet port 28, so that no loss is produced in the force of impact applied by the hammer member 12 to the anvil 5 because the movement of the latter is not interfered with.

When the hammer member 12 impacts the anvil 5, a forward end of the spool valve 18 which extends rightwardly of the hammer member 12 into the fourth bore section 9d as shown in FIG. 3 is mechanically pushed rearwardly as it abuts against a shock absorber 29 located in a substantially central portion of the anvil 5, to thereby close the first duct 21. This terminates the supply of the pressurized working fluid to the third bore section 9c, to restore the percussion tool to the initial condition.

So long as the pressurized working fluid is supplied continuously to teh inlet port 14, the aforesaid series of impacting movements of the hammer member 12 is repeated cyclically, to thereby continue the operation of crushing the working surface.

From the foregoing description, it will be appreciated that in the percussion tool according to the invention, the spool valve located within the hammer member is operative, by the force of a pressurized working fluid supplied thereto, to cause the hammer member to cyclically impact the anvil. The invention eliminates the need to provide a special drive unit for actuating the hammer member, thereby enabling an overall compact size to be obtained in a percussion tool. The arrangement whereby the anvil and hence the chisel point are located within the casing for axial movement relative to the casing enables the vibration force communicated to the operator to be greatly reduced during the hole boring operation because it is only produced by a reaction to the force causing the chisel point to penetrate the working surface.

I claim:

1. A percussion tool comprising:

a hollow casing having a first bore therein, said hollow casing including front, middle and rear casing portions, at least one outlet opening formed at an area between the front and middle casing portions, and a partition member projecting inwardly from an inner surface of the first bore at the middle casing portion thereof, an anvil slidably situated in the first bore at the front portion of the hollow casing, said anvil having a front end adapted to support a chisel point and a rear end, a hammer slidably situated in the front bore behind the rear end of the anvil and having a second fore extending throughout the entire length thereof along the longitudinal direction of the hollow casing, said hammer including front, middle and rear hammer portions, a flange at the rear hammer portion extending radially outwardly toward the hollow casing to thereby define a suction chamber with the hollow casing, hammer, partition member and flange, and first and second and third ducts extending perpendicularly to the longitudinal direction of the hammer and situated at the rear, middle and front hammer portions respectively, means for supplying a pressurized fluid to the suction chamber, said fluid supplying means being connected to the hollow casing, and a valve situated in the second bore of the hammer and having a spring to push the valve rearwardly relative to the hammer and a channel inside the valve so that when the first duct is closed in the valve, the pressurized fluid enters into the suction chamber to move the hammer rearwardly, and when the hammer moves to the rear end, the pressurized fluid enters into the second duct to push the valve frontwardly whereby the pressurized fluid enters into a space behind the hammer through the first duct to move the hammer frontwardly, and when the hammer hits the anvil, the valve is moved rearwardly and closes the first duct.

2. A percussion tool according to claim 1, in which said second bore of the hammer includes a rear bore portion, a front bore portion having a diameter larger than a diameter of the rear bore portion, and an annular recess formed in the front bore portion, and said valve includes a rear valve portion situated in the rear bore portion, and a front valve portion situated in the front bore portion, said front valve portion having a diameter larger than a diameter of the rear valve portion.

3. A percussion tool according to claim 2, in which said valve includes an intermediate portion on the front valve portion adjacent the rear valve portion, a first channel extending from a rear end to the intermediate portion through the rear valve portion, a second channel extending from the intermediate portion to a front end through the front valve portion, and a plurality of small openings at both sides of the intermediate portion extending perpendicularly to the longitudinal direction of the valve so that when the first duct is closed by the valve, air passes to the outlet opening of the hollow casing through the first channel, small opening, the annular recess of the hammer and the second channel.

4. A percussion tool according to claim 3, in which said spring of the valve pushes the valve rearwardly unless the pressurized fluid is applied to the valve through the second duct.

5. A percussion tool according to claim 4, in which said anvil further includes a shock absorber at the rear end thereof to thereby gently push the valve rearwardly when the hammer hits the valve.

* * * * *